US008562303B2

(12) United States Patent
Mori et al.

(10) Patent No.: US 8,562,303 B2
(45) Date of Patent: Oct. 22, 2013

(54) FUEL SUPPLY SYSTEM

(75) Inventors: Hideyuki Mori, Chiryu (JP); Katsuhiko Nakabayashi, Handa (JP)

(73) Assignee: Denso Corporation, Kariya (JP)

( * ) Notice: Subject to any disclaimer, the term of this patent is extended or adjusted under 35 U.S.C. 154(b) by 169 days.

(21) Appl. No.: 13/033,749

(22) Filed: Feb. 24, 2011

(65) Prior Publication Data

US 2011/0206539 A1 Aug. 25, 2011

(30) Foreign Application Priority Data

Feb. 25, 2010 (JP) ..... 2010-40702
Oct. 29, 2010 (JP) ..... 2010-243236

(51) Int. Cl.
*F04B 49/06* (2006.01)

(52) U.S. Cl.
USPC ..... 417/43; 417/42; 417/44.2; 123/497

(58) Field of Classification Search
USPC ..... 417/43, 44.2, 42; 123/497
See application file for complete search history.

(56) References Cited

U.S. PATENT DOCUMENTS

| | | | | |
|---|---|---|---|---|
| 5,355,859 | A | 10/1994 | Weber | |
| 5,850,818 | A * | 12/1998 | Yoshiume et al. | 123/497 |
| 6,431,147 | B1 * | 8/2002 | Hiraiwa et al. | 123/458 |
| 7,399,165 | B2 * | 7/2008 | Horiuchi et al. | 417/42 |
| 2005/0180868 | A1 * | 8/2005 | Miller | 417/437 |

* cited by examiner

*Primary Examiner* — Charles Freay
*Assistant Examiner* — Patrick Hamo
(74) *Attorney, Agent, or Firm* — Nixon & Vanderhye PC

(57) ABSTRACT

A fuel supply system has an in-tank module. The in-tank module is provided with a pump, a filter, a pressure regulator and a pressure sensor detecting a fuel pressure. The pressure sensor is disposed on or at a vicinity of the fuel pump so that the pressure sensor easily detects a pulsation component due to the pump. A fuel pump controller includes a speed detection module which detects the rotation speed of the fuel pump based on a cycle of the pulsation component of the pressure detected by the pressure sensor. Thus, the rotation speed of the fuel pump can be indirectly detected by means of the pressure sensor.

11 Claims, 12 Drawing Sheets

FUEL SUPPLY SYSTEM

CROSS-REFERENCE TO RELATED APPLICATION

This application is based on Japanese Patent Applications No. 2010-40702 filed on Feb. 25, 2010, and No. 2010-243236 filed on Oct. 29, 2010, the disclosures of which are incorporated herein by reference.

FIELD OF THE INVENTION

The present invention relates to a fuel supply system which supplies fuel in a fuel tank to a fuel-consuming apparatus by use of an electric pump.

BACKGROUND OF THE INVENTION

JP-7-103105A (U.S. Pat. No. 5,355,859) shows a fuel supply system having a pressure sensor provided to a fuel rail and a control circuit controlling electricity supplied to a fuel pump based on an output of the pressure sensor. A plurality of fuel injectors are provided to the fuel rail. In this fuel supply system, a pulse width supplied to the injector has linearity to a fuel injection quantity injected by the injector.

The pressure in the fuel rail has various pressure components. However, the pressure sensor only detects pressure which is linear to the fuel injection quantity.

Further, the fuel pressure supplied from the fuel supply system includes pulsation components which indicate an operation condition of the fuel supply system. For example, the fuel pressure includes high frequency component which indicates an operation condition of an electric pump.

However, in the above fuel supply system, such a pulsation components are not detected by the pressure sensor. In other word, the pressure sensor is not utilized fully enough.

Further, the pressure sensor is provided to the fuel rail. Thus, a pulsation component due to the fuel pump may be attenuated at a position where the pressure sensor is positioned. Furthermore, a pulsation component due to the fuel pump is overlapped with a pulsation component due to the injector. Thus, it is relatively difficult to detect the pulsation component due to the pump.

Besides, in the above conventional system, there is no apparatus which detects a rotation speed of the pump. Thus, no control can be executed based on the rotation speed of the pump.

SUMMARY OF THE INVENTION

The present invention is made in view of the above matters, and it is an object of the present invention to provide a fuel supply system which is capable of detecting a rotation speed of a pump.

Another object of the present invention is to provide a fuel supply system which can effectively utilize a pressure sensor provided to the fuel supply system.

Another object of the present invention is to provide a fuel supply system which can detect a rotation speed of a fuel pump by means of a pressure sensor.

The other object of the present invention is to provide a fuel supply system which can detect a pulsation component due to a pump.

According to the present invention, a fuel supply system includes: a fuel pump driven by an electric motor; a sensor detecting a pulsation component included in a pressure of the fuel which is supplied to the fuel-consuming apparatus from the pump; and a speed detection means for detecting a rotation speed of the fuel pump based on a periodic component of the pulsation component detected by the sensor.

The rotation speed of the fuel pump can be indirectly detected.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Figure 1:
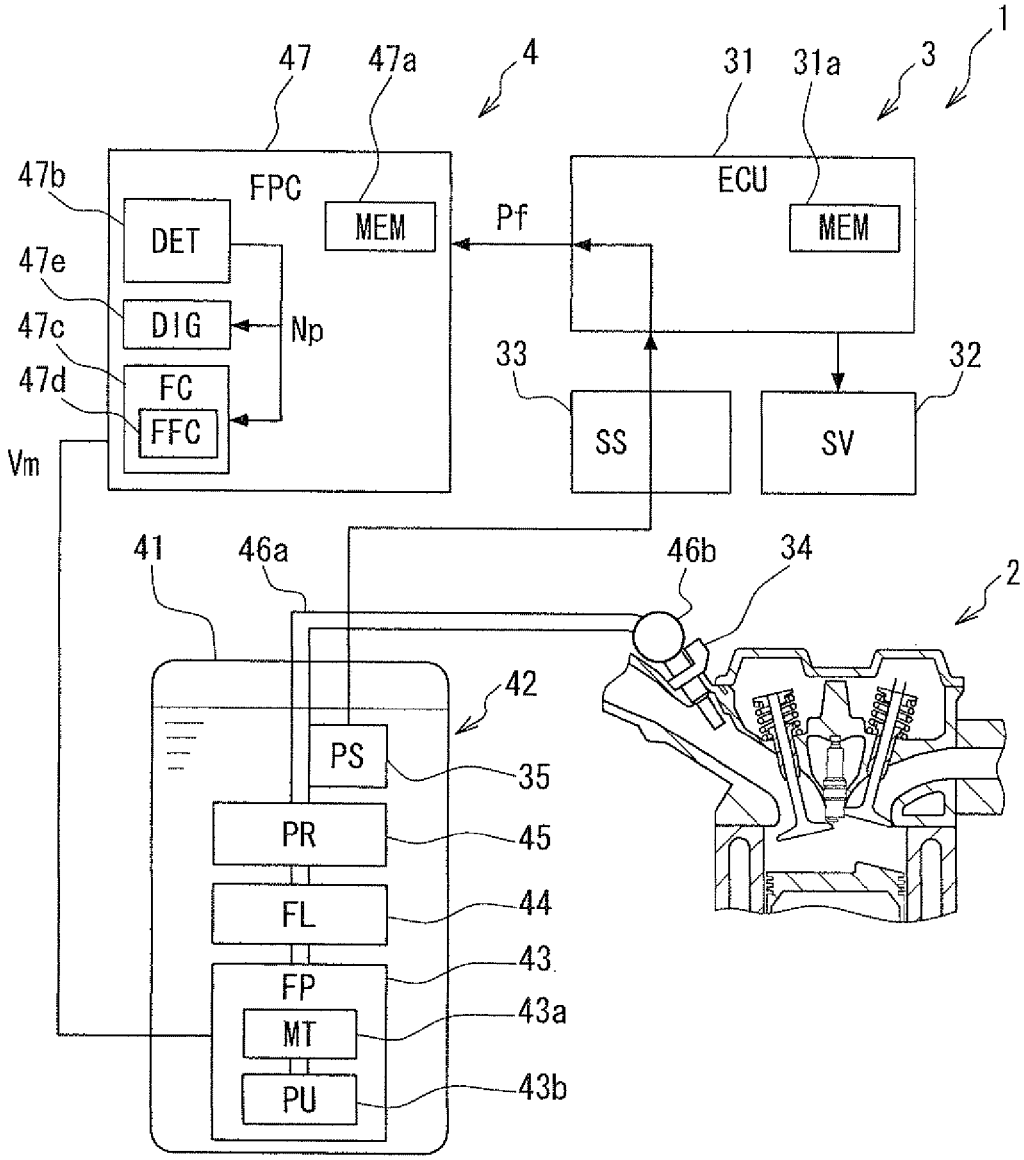
FIG. 1 is a block diagram showing an internal combustion engine system according to a first embodiment.

Referring to drawings, embodiments of the present invention will be described hereinafter. In these embodiments, the same parts and components as those in each embodiment are indicated with the same reference numerals and the same descriptions will not be reiterated. Each of following embodiments can be combined suitably.

First Embodiment

FIG. 1 is a block diagram showing an internal combustion engine system 1 according to a first embodiment. The internal combustion engine system 1 for an automobile is comprised of an internal combustion engine 2, which corresponds to a fuel-consuming apparatus, an engine control system 3 and a fuel supply system 4. The internal combustion engine 2 is a gasoline engine. It should be noted that the internal combustion engine 2 can replaced by another fuel-consuming apparatus, such as an external combustion engine, a heating apparatus and the like.

The engine control system 3 is provided with an electronic control unit (ECU) 31, actuators (SV) 32, and sensors (SS) 33. The ECU 31 includes a microcomputer having a memory media (MEM) 31*a*. The MEM 31*a* stores various programs which the computer executes.

The actuators (SV) 32 includes a throttle actuator for adjusting an intake air flow rate, an ignition controller controlling an ignition timing, and an fuel injector 34.

The sensors (SS) 33 include a plurality of sensors which detect a condition of the internal combustion engine 2. For example, the sensors (SS) 33 includes a speed sensor detecting engine speed, and a pressure sensor detecting intake air pressure. Further, the sensors (SS) 33 includes a fuel pressure sensor (PS) 35 detecting a fuel pressure which will be supplied to the fuel injector 34. The fuel pressure sensor (PS) 35 is a pulsation detection means.

The fuel supply system 4 has a fuel tank 41 which stores gasoline. Further, the fuel supply system 4 has an in-tank module 42 accommodated in the fuel tank 41. The in-tank module 42 is provided with a fuel pump (FP) 43, a filter (FL) 44 and a pressure regulator (PR) 45. The pump 43 is an electric pump which pumps up fuel from the fuel tank 41 and pressurizes the pumped fuel. This pressurized fuel is supplied to the injector 34. The filter (FL) 44 is arranged between the fuel pump 43 and the injector 34 to filtrate the fuel flowing through a fuel passage. The pressure regulator 45 is arranged between the fuel pump 43 and the injector 34. The pressure regulator 45 returns excessive fuel to the fuel tank 41 so that the fuel pressure is adjusted to a specified value. A fuel pipe 46*a* extends from the in-tank module 42 to a fuel rail 46*b* which distributes the fuel to each injector 34. A fuel supplying system is established from the in-tank module 42 to the injector 34 without any return pipe.

The pump 43 has a motor (MT) 43*a* and a hydraulic pump unit (PU) 43*b*. The motor 43*a* is a direct-current (DC) motor having a brush. The hydraulic pump unit 43*b* is a regenerative pump driven by the motor 43*a*.

FIG. 1 is a side view of the in-tank module 42. The in-tank module 42 is coupled to a lid 41*a* which covers an opening of the fuel tank 41. The in-tank module 42 is supported in the fuel tank 41 by the lid 41*a*. The in-tank module 42 is provided with a connector 41*b* and an outlet pipe 41*c*. The outlet pipe 41*c* is a part of the fuel pipe 46*a*.

The in-tank module 42 has a sub tank 42*a*, a plurality of supporting rods 42*b*, a pump-assembly 42*d*, a first pipe 42*e*, and a second pipe 42*f*. The sub tank 42*a* is equipped with a fuel quantity sensor 36 which measures fuel quantity in the fuel tank 41.

The sub tank 42*a* keeps the full level high around the fuel pump 43 even if the remaining fuel in the tank 41 is decreased. The sub tank 42*a* can be equipped with a sub-pump (not shown) which pumps up the fuel in the fuel tank 41 and supplies the fuel to the sub tank 42*a*. The sub-pump is a jet pump which is operated by a return fuel from the pressure regulator 45. The supporting rods 42*b* connect the lid 41*a* and the sub tank 42*a*. The supporting rods 42*b* is slidably coupled to the sub tank 42*a*, so that a distance between the lid 41*a* and the sub tank 42*a* is adjustable. A spring 42*c* biases the sub tank 42*a* toward a bottom of the fuel tank 41. The supporting rods 42*b* and the spring 42*c* stably support the sub tank 42*a* even if the bottom of the fuel tank 41 is deformed.

The first pipe 42*e* extends from the pump assembly 42*d*. One end of the first pipe 42*e* is connected to an outlet of the pump-assembly 42*d*. The other end of first pipe 42*e* is connected to an inlet of the pressure sensor 35. Furthermore, one end of the second pipe 42*f* is connected to an outlet of the pressure sensor 35, and the other end is connected to the outlet pipe 41*c*. The first and the second pipe 42*e*, 42*f* are flexible accordion pipes made of resin material. The fuel discharged from the pump-assembly 42*d* is supplied to the fuel injector 34 through the first pipe 42*e*, the pressure sensor 35, the second pipe 42*f*, and the outlet pipe 41*c*.

The connector 41*b* is for connecting the pressure sensor 35, the motor 43*a* and the fuel quantity sensor 36 with the ECU 31.

Figure 3:
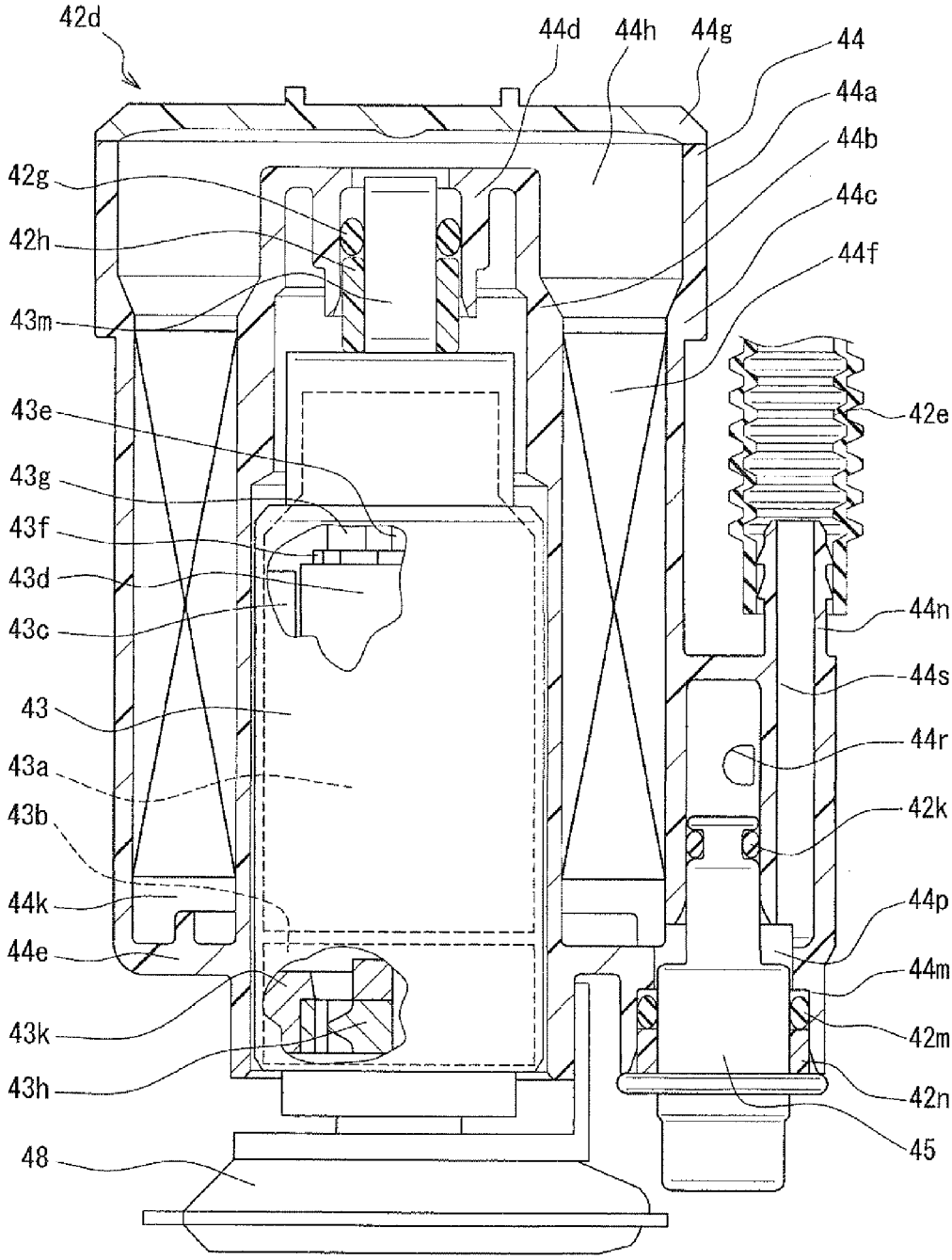
FIG. 3 is a partly sectional view showing a pump-assembly according to the first embodiment.

FIG. 3 is a partly sectional view showing a pump-assembly 42*d*. The pump-assembly 42*d* is comprised of the fuel pump 43, the filter 44 and the pressure regulator 45. Further, the pump-assembly 42*d* is equipped with a suction filter 48 which is provided to a suction port of the fuel pump 43.

The pump 43 has the motor 43*a* and the hydraulic pump unit 43*b*. The motor 43*a* has a stator 43*c* and a rotor 43*d*. The rotor 43*d* is rotatably supported by a shaft 43*e*. The rotor 43*d* has a commutator 43*f*. The commutator 43*f* is in contact with a brush 43*g*. The rotor 43*d* has a coil (not shown). This coil is energized through the brush 43*g* and the commutator 43*f*. The motor 43*a* is controlled by a fuel pump controller (FPC) 47 to drive the hydraulic pump unit 43*b*.

The hydraulic pump unit 43*b* is a regeneration pump which is one of non-positive-displacement pumps. The pump unit 43*b* includes an impeller 43*h* and a casing 43*k* which accommodates the impeller 43*h*. The casing 43*k* has a suction port (not shown) and a discharge port (not shown). The impeller 43*h* is driven by the motor 43*a*. The hydraulic pump unit 43*b* suctions the fuel in the sub tank 42*a* through the suction filter 48 and discharges the pumped fuel through a discharge pipe 43*m*.

The rotation speed of the motor 43*a* includes a rotational variation component due to a configuration of the motor 43*a*. For example, the rotation speed of the motor fluctuates due to a variation in contact condition between the brush 43*g* and the commutator 43*f*. The contact condition between the brush 43*g* and the commutator 43*f* periodically changes in synchronization with a rotation of the rotor 43*d*. Thus, the rotational variation component synchronizes with the rotation of the rotor 43*d*. The operation of the pump unit 43*b* is also fluctuated due to the rotational variation component. As a result, the fuel pressure discharged from the pump unit 43*b* also has pulsation components corresponding to the rotational variation component.

Further, the fuel pressure pressurized by the pump unit 43*b* includes pulsation components due to a configuration thereof. The pulsation components synchronize with the rotation of the pump unit 43*b*. For example, the fuel pressure includes the pulsation components due to a plurality of channels formed on the impeller 43*h* and a communication condition between the suction port and the discharge port.

Thus, the fuel pressure pressurized by the pump unit 43*b* includes the pulsation components due to the configuration of the fuel pump 43. These pulsation components include the pulsation components due to a configuration of the motor 43*a* and the pulsation component due to a configuration of the pump unit 43*b*.

A resin housing 44*a* of the filter 44 is utilized as a frame of the pump-assembly 42*d*. The pump 43 and the pressure regulator 45 are fixed on the housing 44*a*. The housing 44*a* is fixed on the sub tank 42*a*. The housing 44*a* is formed cylindrical or C-shaped. The housing 44*a* is comprised of an inner housing

44*b* and an outer housing 44*c*. The inner housing 44*b* defines a fuel pump chamber in which the fuel pump 43 is held. An inlet pipe 44*d* is formed at upper end of the inner housing 44*b*. The inlet pipe 44*d* protrudes inward. The discharge pipe 43*m* of the fuel pump 43 is inserted into the inlet pipe 44*d*. An O-ring 42*g* and a spacer 42*h* are arranged between the inlet pipe 44*d* and the discharge pipe 43*m*.

The lower ends of the inner housing 44*b* and the outer housing 44*c* are closed by a bottom plate 44*e*. A filter chamber is defined between the inner housing 44*b* and the outer housing 44*c*. A filter element 44*f* is accommodated in the filter chamber. The filter element 44*f* filtrates the fuel flowing through the housing 44*a*. An upper open end of the outer housing 44*c* is closed by a cover 44*g*. The outer housing 44*c* and the cover 44*g* are liquid-tightly connected with each other by welding. An upstream gallery 44*h* is defined upstream of the filter element 44*f*. A downstream gallery 44*k* is defined downstream of the filter element 44*f*.

A cylindrical portion 44*m* for accommodating the pressure regulator 45 therein and the outlet pipe 44*n* are formed on a side wall of the housing 44*a*. A control gallery 44*p* and a return gallery 44*r* are defined in the cylindrical portion 44*m*. O-rings 42*k*, 42*m* and a spacer 42*n* are disposed between the cylindrical portion 44*m* and the pressure regulator 45. A control gallery 44*p* communicates with the downstream gallery 44*k*. The control gallery 44*p* communicates with an outlet passage 44*s* defined by the outlet pipe 44*n*. A return gallery 44*r* communicates with the sub tank 42*a* through a sub-pump (not shown).

The housing 44*a* defines a fuel passage through the inlet pipe 44*d*, the upstream gallery 44*h*, the filter element 44*f*, the downstream gallery 44*k*, the control gallery 44*p*, and the outlet passage 44*s* in this series.

The pressure regulator 45 returns the fuel from the control gallery 44*p* to the return gallery 44*r* in such a manner that the pressure in the control gallery 44*p* is maintained at a predetermined value. The pressure in the control gallery 44*p* and passages communicating therewith are kept at the predetermined value.

Figure 2:
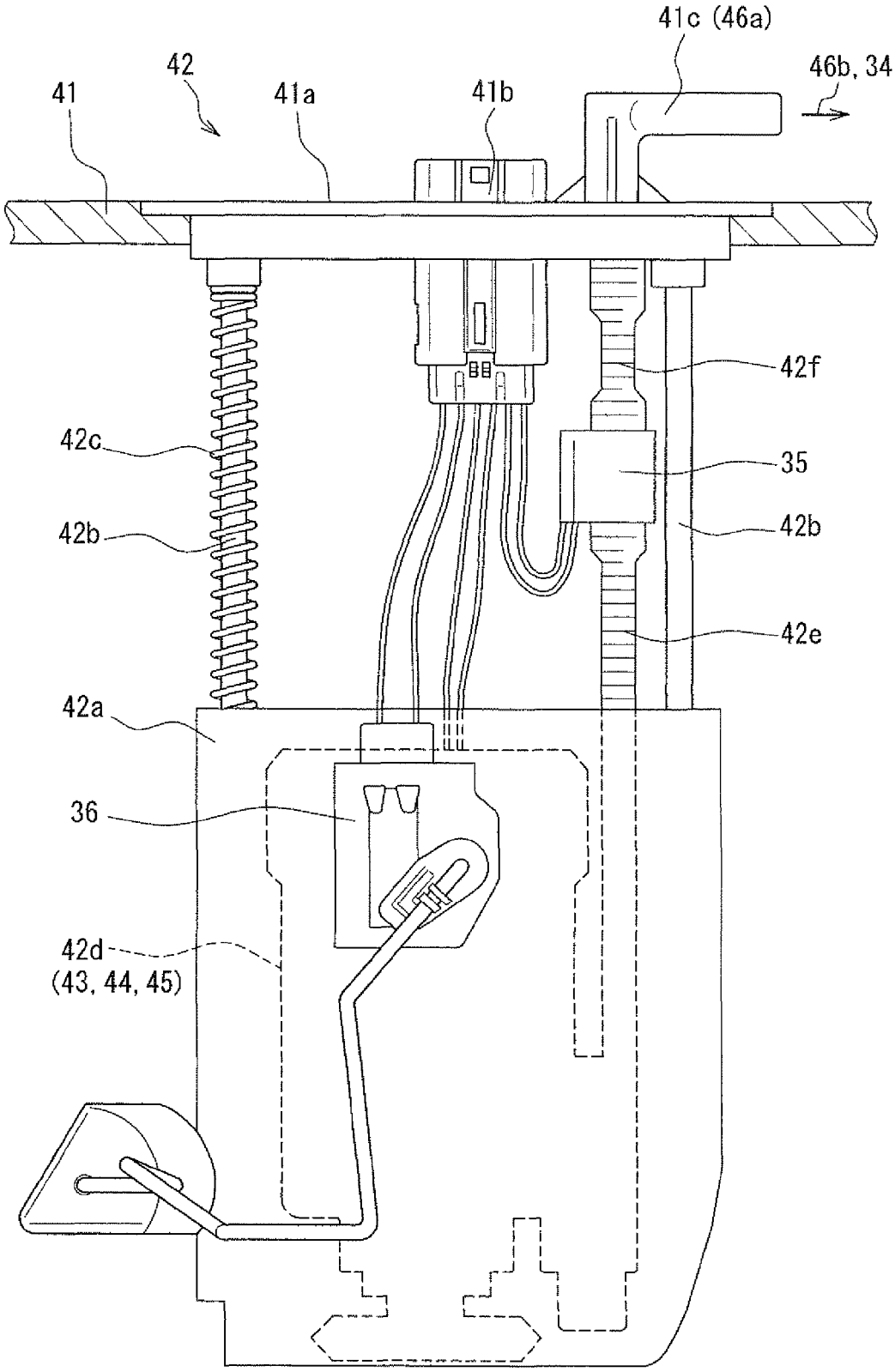
FIG. 2 is a side view of the in-tank module according to the first embodiment.

As shown in FIGS. 2 and 3, the pressure sensor 35 is accommodated in the fuel tank 41 and is close to the fuel pump 43. The pressure sensor 35 is installed in the position near the fuel pump 43 among the passages of the fuel between the fuel pump 43 and the injector 34. The pressure sensor 35 can detects a slight pulsation component due to the fuel pump 43. Meanwhile, the pulsation components due to successive injections by the injector 34 are generated in the fuel passage. However, the pressure sensor 35 is arranged apart from the injector 34. The pulsation components due to the fuel injection are attenuated at a position where the pressure sensor 35 is provided. Thus, the pulsation components due to the fuel injection can be reduced from the output of the pressure sensor 35.

Further, since the pressure sensor 35 is provided between the first pipe 42*e* and the second pipe 42*f*, the pressure sensor 35 can be installed to even a conventional pump assembly without any difficulties.

Still further, since the pressure sensor 35 is provided in the in-tank module 42, the connector 41*b* for the fuel pump 43 can be utilized for the pressure sensor 35. The shape of the fuel tank 41 and the lid 41*a* depends on a vehicle on which the fuel tank 41 is mounted. However, since the pressure sensor 35 is provided in the in-tank module 42, its configuration is common to plurality kinds of vehicles.

The pressure sensor 35 can be provided without any restriction of the shape of lid 41*a*.

Referring back to FIG. 1, the fuel supply system 4 includes the fuel pump controller (FPC) 47 which controls the rotation speed of the motor 43*a*. The FPC 47 includes a memory media (MEM) 47*a*. The MEM 47*a* stores various programs which the computer executes.

The FPC 47 includes a plurality of modules. A speed detection module (DET) 47*b*, which corresponds to a speed detection means, extracts a periodic pulsation component due to the configuration of the fuel pump 43 and detects the rotation speed Np of the motor 43*a* based on the extracted pulsation component. A control module (FC) 47*c* controls the rotation speed Np in such a manner that the pressure Pf detected by the pressure sensor 35 agrees with the target pressure. The control module 47*c* includes a feedforward control module (FFC) 47*d* which feedforward controls the rotation speed of the motor 43*a* so that the pressure Pf is maintained at the target pressure. A diagnosis-module (DIG) 47*e* outputs the rotation speed Np detected by the speed detection module (DET) 47*b* in response to a diagnosis-signal which requires an output of diagnosis information.

Figure 4:
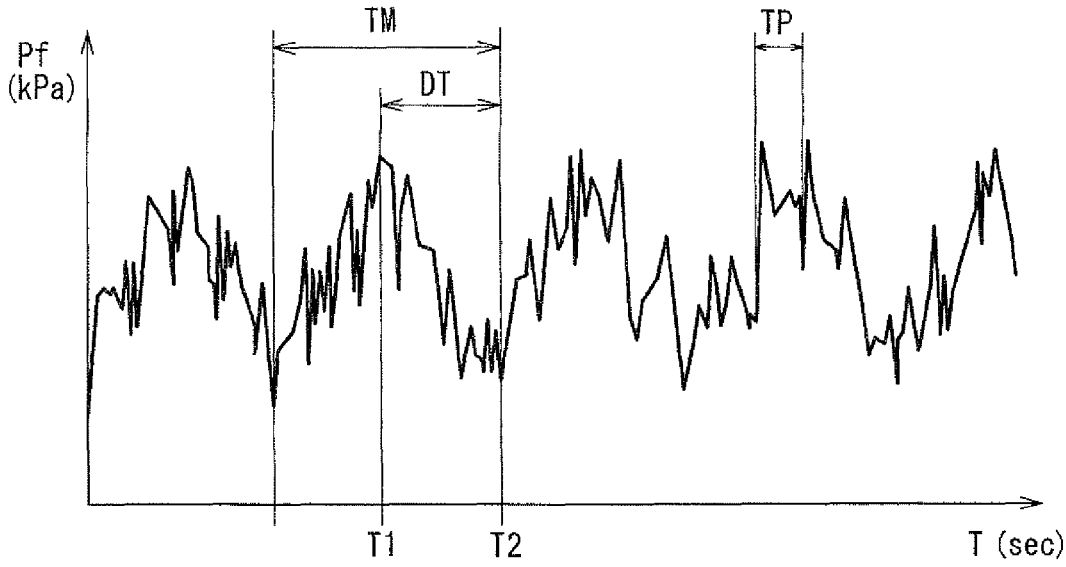
FIG. 4 is a graph showing a variation in a fuel pressure according to the first embodiment.

FIG. 4 is a graph showing a variation in the pressure Pf according to the first embodiment. This graph indicates a stable operating condition of the fuel supply system. The pressure Pf includes the periodic pulsation component. The periodic pulsation component includes a plurality of components of which cycle is different from each other. The pulsation due to the configuration of the motor 43*a* has a relatively long cycle TM. This cycle TM can be obtained by detecting a time period DT which corresponds to half of the cycle TM. The time period DT can be obtained by detecting a time T1 and a time T2. At the time T1, the pressure Pf becomes a peak value. At the time T2, the pressure Pf becomes a bottom value. Based on the time period DT, the rotation speed Np of the motor 43*a* is computed as follows:

$$Np=1/TM=1/2\times DT$$

The pulsations include a plurality of components of which cycle TP is shorter than the cycle TM. These short period components can be, eliminated by filtering process.

Figure 5:
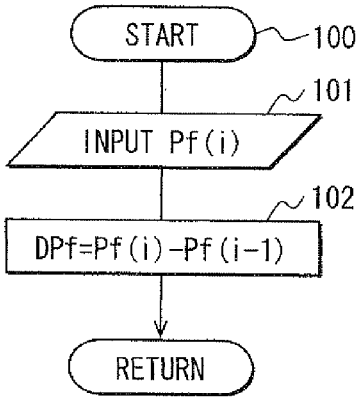
FIG. 5 is a flow chart showing a processing of the fuel supply system according to the first embodiment.

FIG. 5 is a flowchart showing a differential pressure computing processing which the FPC 47 executes. The differential pressure computing processing 100 is executed at a specified sampling interval. In this processing 100, a variation DPF in pressure signal which the pressure sensor 35 outputs per specified unit period is computed. In step 101, the computer inputs the pressure Pf(i) detected by the pressure sensor 35. A filtering process can be executed in step 101. In this filtering process, frequency components close to the cycle TM are passed. For example, equalization processing can be used. It is desirable to eliminate high-frequency components of which frequency is higher than the cycle TM. The sampling period can be set not to reflect a variation in short cycle TP. In step 102, the computer computes a variation DPf which corresponds to a difference between the previous pressure Pf(i−1) and the current pressure Pf(i).

Figure 6:
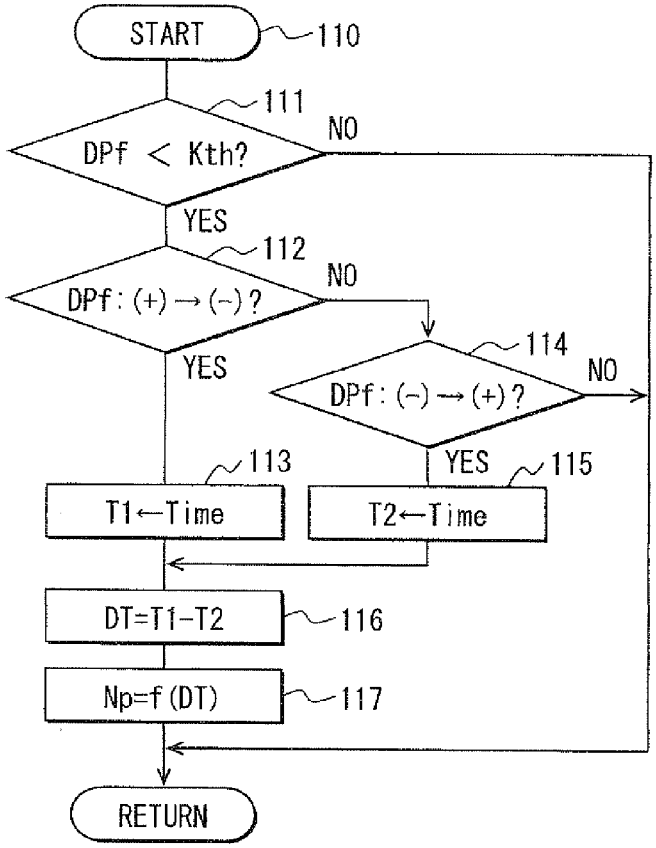
FIG. 6 is a flow chart showing a processing of the fuel supply system according to the first embodiment.

FIG. 6 is a flowchart showing a speed computing processing which the FPC 47 executes. In the speed computing processing 110, the computer computes the cycle by detecting the periodic pulsation component of the pressure Pf, and computes the rotation speed Np of the motor 43*a*. The speed detection module 47*b* executes the differential pressure computing processing 100 and the speed computing processing 110.

In step 111, the computer determines whether the variation DPf is less than a specified value Kth. When the variation DPf is not less than the value Kth, the computer determines that the fuel pump 43 is in a transitional operation condition. For example, the fuel pump 43 has been just started. Thus, when the answer is NO in step 111, the rotation speed Np is not computed. That is, immediately after the fuel pump 43 is started, a computation of the rotation speed Np is prohibited, so that an erroneous computation of the rotation speed Np can be avoided.

When the answer is YES in step 111, the procedure proceeds to step 112 in which the computer determines whether the variation DPf is turned from a positive value (+) to a negative value (−). That is, it is determined whether the increase in pressure Pf(i) is turned to the decrease in pressure Pf(i). In other words, a peak of the pressure Pf(i) is detected in step 112. When the answer is YES in step 112, the procedure proceeds to step 113. In step 113, a timing at which the peak is detected is stored as a first timing T1.

When the answer is NO in step 112, the procedure proceeds to step 114. In step 114, the computer determines whether the variation DPf is turned from a negative value (−) to a positive value (+). That is, it is determined whether the decreased in pressure Pf(i) is turned to the increased in pressure Pf(i). In other words, a bottom of the pressure Pf(i) is detected in step 114. When the answer is YES in step 114, the procedure proceeds to step 115. In step 115, a timing at which the bottom is detected is stored as a second timing T1.

In step 116, a differential time period between the first timing T1 and the second timing T2 is computed as a differential time DT. In step 117, the computer computes the rotation speed Np of the motor 43*a* based on the differential timing DT.

$$Np=f(DT)$$

This function f(DT) is defined based on the cycle TM and the configuration of the motor 43*a*, such as a pole number of the stator 43*c*, a pole number of the rotor 43*d*, and the pole number of the commutator 43*f*. The rotation speed Np of the motor 43*a* computed in step 117 is stored in the memory of the FPC 47.

$$Np=1/TM=1/2\times DT$$

Figure 7:
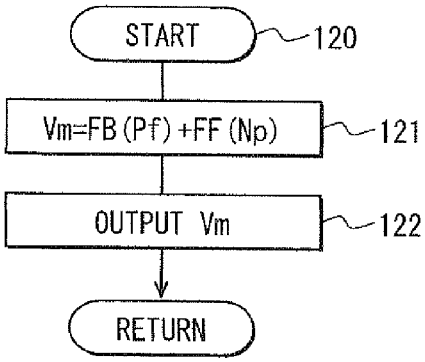
FIG. 7 is a flow chart showing a processing of the fuel supply system according to the first embodiment.

FIG. 7 is a flowchart showing a motor control processing which the FPC 47 executes. In the motor control processing 120, the computer computes voltage Vm which is applied to the motor 43*a* so that the pressure Pf is maintained at the target pressure. The control module 47*c* executes the motor control processing 120.

In step 121, the voltage Vm is computed based on the pressure Pf detected by the pressure sensor 35 and the rotation speed Np of the motor 43*a*. The voltage Vm is computed based on a feedback amount FB(Pf) and a feedforward amount FF(Np). The feedback amount FB(Pf) is computed based on the pressure Pf, and the feedforward amount FF(Np) is computed based on the rotation speed Np. The feedback amount FB(Pf) is computed by feedback control, such as PI control and the PID control. The feedforward amount FF(Np) is computed based on the rotation speed Np in order to obtain higher response than the feedback amount FB(Pf). The voltage Vm may be computed based on a basic voltage Vbase, the feedback amount FB(Pf), the feedforward amount FF(Np), and a correction amount Vcor. The correction amount Vcor may include voltage Vrel for canceling a locking condition of the fuel pump 43. The locking condition occurs when the fuel pump 43 suctions a foreign matter. Also, the correction amount Vcor may include voltage Vmech for compensating an increase in mechanical load of the fuel pump 43. In step 122, the computed voltage Vm is applied to the motor 43*a*.

Figure 8:
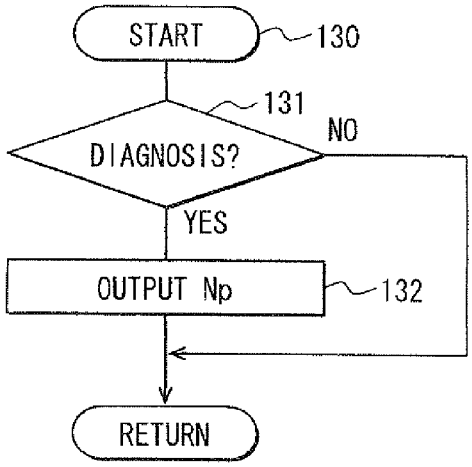
FIG. 8 is a flow chart showing a processing of the fuel supply system according to the first embodiment.

FIG. 8 is a flowchart showing a diagnosis-processing which the FPC 47 executes. In the diagnosis-processing 130, the rotation speed Np is outputted when the diagnosis-signal is inputted. The diagnosis-module 47*e* executes the diagnosis-processing 130.

In step 131, the computer determines whether the diagnosis-signal is inputted. When the answer is YES, the procedure proceeds to step 132 in which the rotation speed Np computed in the speed computing processing 110 is outputted. This rotation speed Np is indicated on a display (not shown) provided to the internal combustion engine system 1 or a diagnosis device (not shown). Thereby, it is diagnosed whether the motor 43*a* is normally operated.

According to the embodiment described above, the rotation speed Np of the fuel pump 43 is obtained based on the fuel pressure Pf detected by the pressure sensor 35. The rotation speed Np of the fuel pump 43 can be indirectly detected. Further, the pressure sensor 35 is utilized for controlling the fuel pressure. Thus, the pressure sensor 35 is utilized fully enough. Further, the pressure sensor 35 can detect the pulsation due to the fuel pump 43 while reducing the pulsation components due to the injector 34.

Second Embodiment

Figure 9:
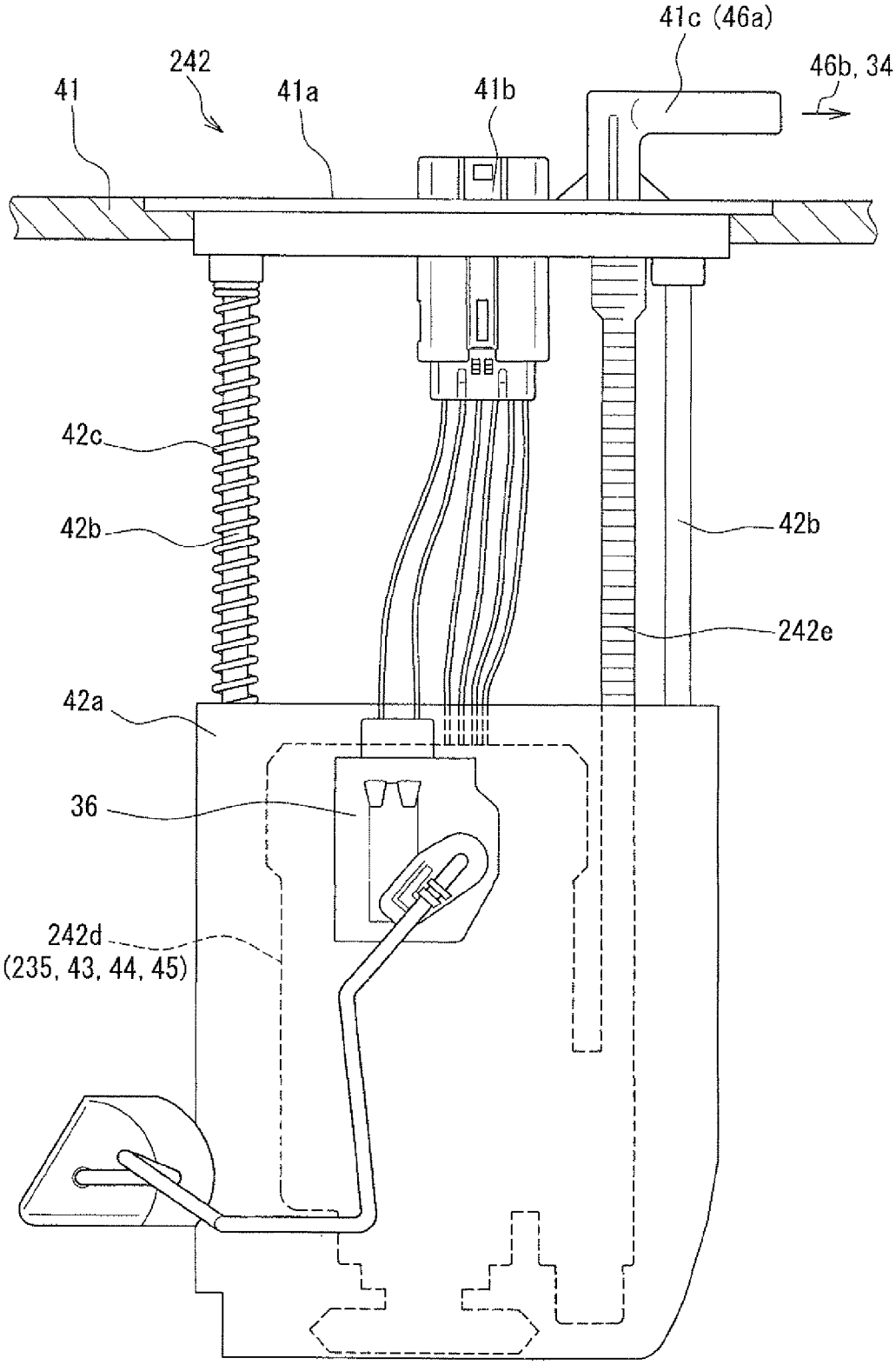
FIG. 9 is a side view of the in-tank module according to a second embodiment.
Figure 10:
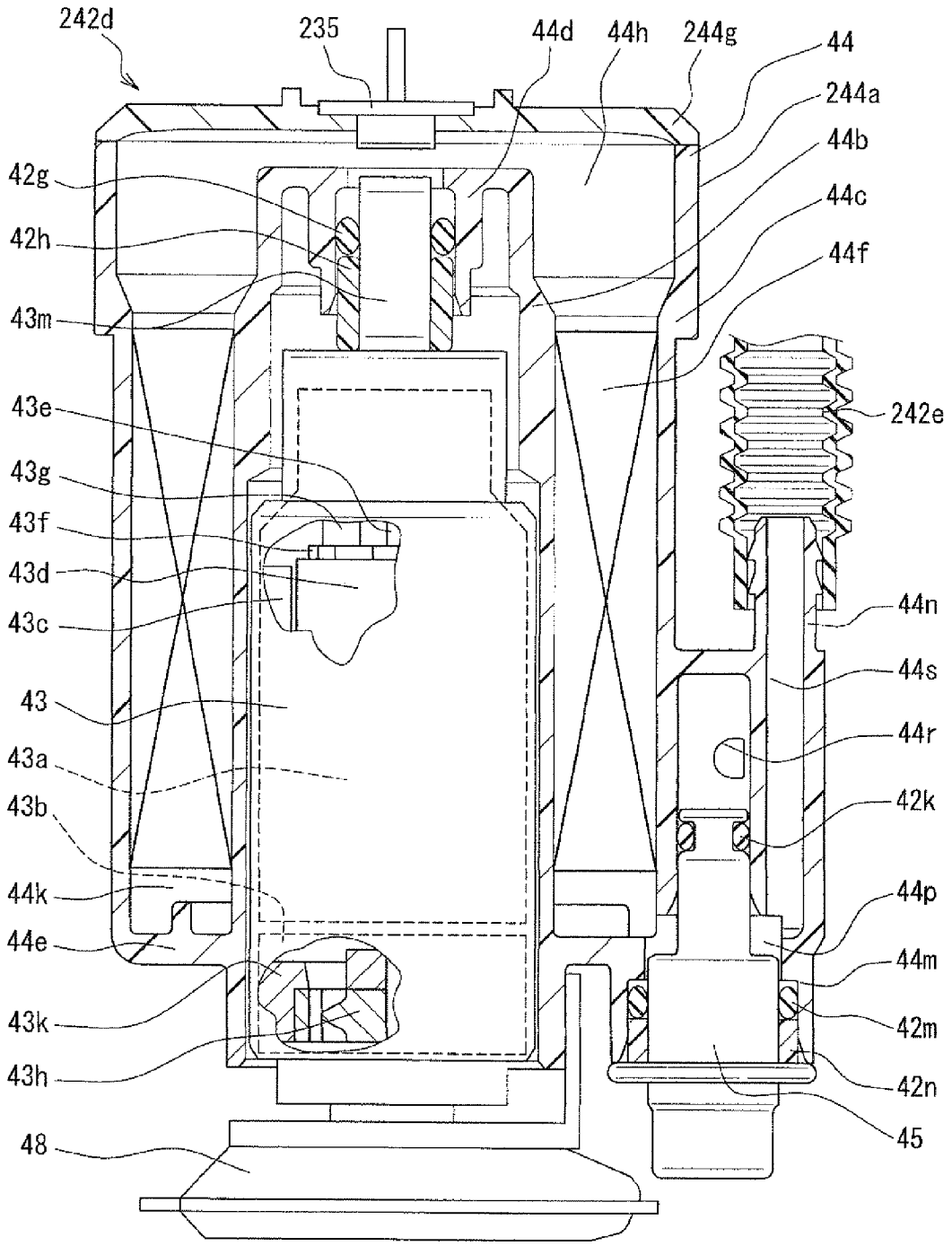
FIG. 10 is a partly sectional view showing a pump-assembly according to the second embodiment.

FIG. 9 is a side view of the in-tank module 242 according to a second embodiment. FIG. 10 is a partly sectional view showing a pump-assembly 242*d*. In the present embodiment, the pressure sensor 235 is installed to the fuel pump assembly 242*d*. The in-tank module 242 has a connecting pipe 242*e* connecting the outlet pipe of the pump assembly 242*d* and the outlet pipe 41*c*.

The pump assembly 242*d* is provided with a pressure sensor 235. The pressure sensor 235 is connected to a housing 244*a* in such a manner as to detect fuel pressure in the housing 244*a*.

Specifically, the pressure sensor 235 is fixed on a cover 244*g* to be exposed in the upstream gallery 44*h*. The pressure sensor 235 confronts an opening end of the discharge pipe 43*m*.

The pressure sensor 235 detects fuel pressure in the upstream gallery 44*h* between the fuel pump 43 and the filter element 44*f*. More specifically, the pressure sensor 235 detects pressure of fuel which discharged from the discharge pipe 43*m* immediately after the fuel is discharged therefrom.

According to the present embodiment, the pressure sensor 235 can be arranged at a position where an attenuation of the pulsation component due to the fuel pump 43 is relatively small.

Third Embodiment

Figure 11:
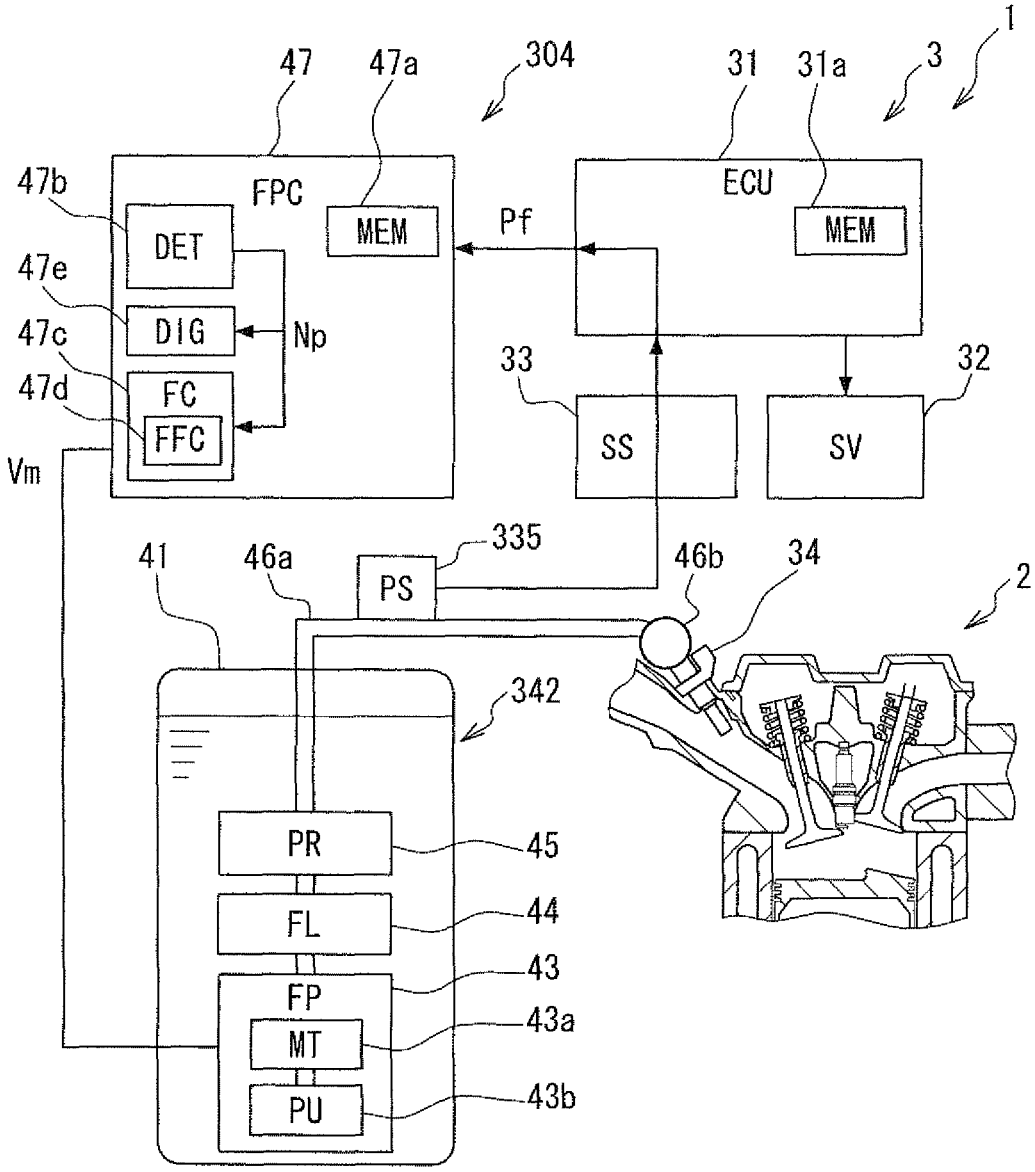
FIG. 11 is a block diagram showing a fuel supply system according to a third embodiment.

FIG. 11 is a block diagram showing a fuel supply system 304 according to a third embodiment. This fuel supply system 304 has a pressure sensor 335 provided to the fuel pipe 46*a* between the in-tank module 342 and the fuel rail 46*b*. The in-tank module 342 has a configuration of the first embodiment from which the pressure sensor 35 is removed.

The pressure sensor 335 detects fuel pressure Pf flowing through the fuel pipe 46*a*. Also in this embodiment, the speed detection module 47*b* detects the rotation speed Np of the motor 43*a* based on the pulsation component of the fuel pressure Pf.

Fourth Embodiment

Figure 12:
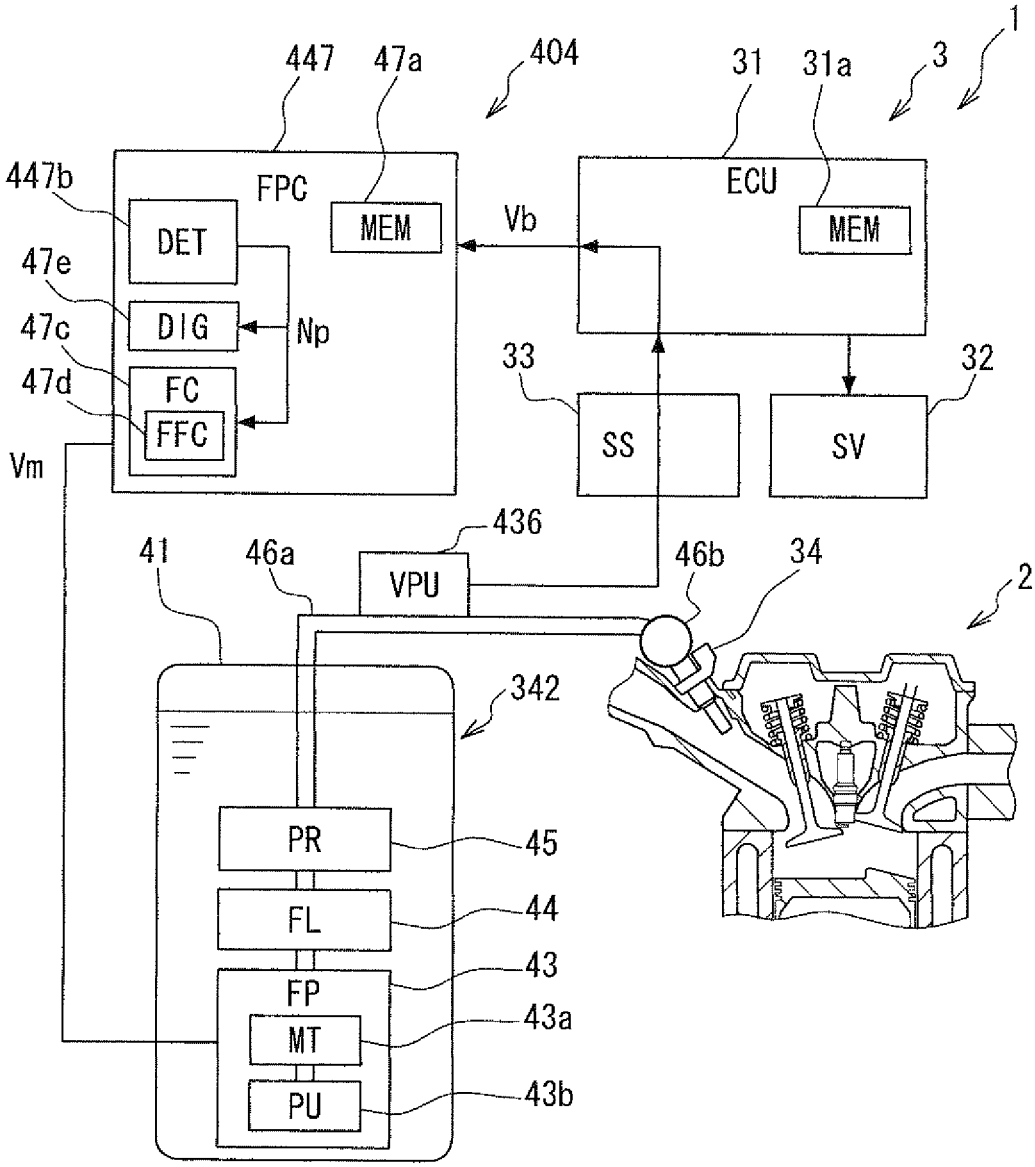
FIG. 12 is a block diagram showing a fuel supply system according to a fourth embodiment.

FIG. 12 is a block diagram showing a fuel supply system 404 according to a fourth embodiment. This fuel supply system 404 has a vibration-pickup sensor (VPU) 436 provided to the fuel pipe 46*a* between the in-tank module 342 and the fuel rail 46*b*. The vibration-pickup sensor 436 can be provided to the fuel pump 43 or other portion close to the fuel pump 43.

The vibration pickup sensor 436 detects vibration of the fuel pipe 46*a*. The vibration of the fuel pipe 46*a* includes a pulsation component due to a pulsation of the fuel pressure Pf in the fuel pipe 46*a*. Thus, the vibration pickup sensor 436 can output a detection signal corresponding to a pulsation component due to the configuration of the motor 43*a*. According to the present embodiment, the speed detection module 447*b* detects the rotation speed Np of the motor 43*a* based on the periodic pulsation component included in the vibration Vb detected by the vibration pickup sensor 436.

Fifth Embodiment

Figure 13:
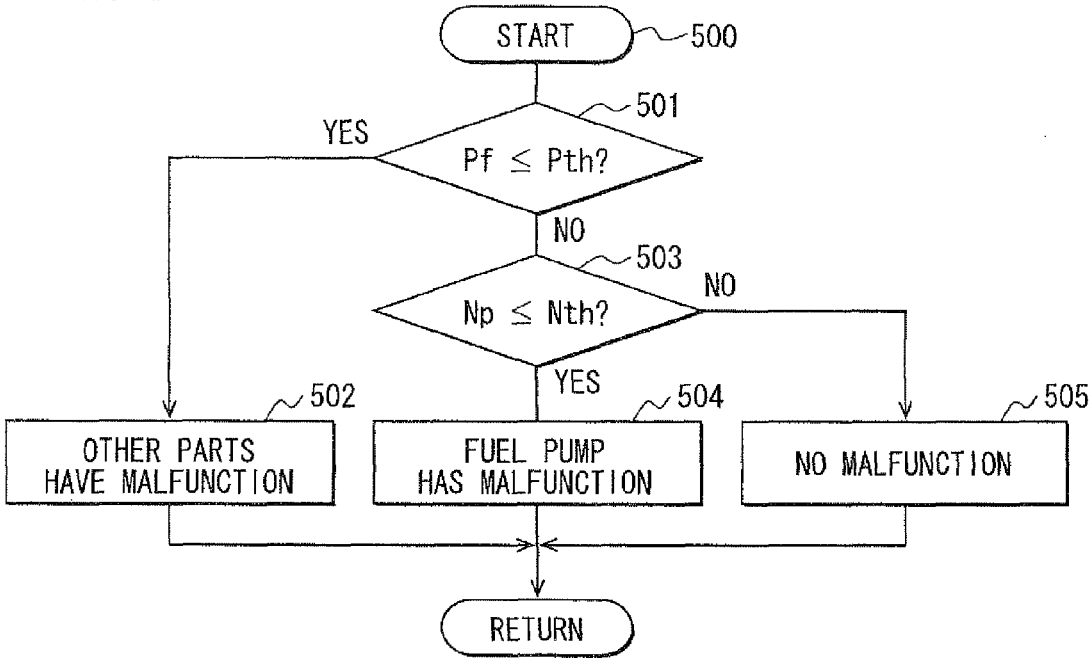
FIG. 13 is a flow chart showing a processing of the fuel supply system according to a fifth embodiment.

FIG. 13 is a flowchart showing a determination processing which the FPC 47 executes. In the determination processing 500, the computer determines whether the fuel pump 43 has a malfunction based on the pressure Pf detected by the pressure sensor 35 and the rotation speed Np derived from the pressure Pf. Furthermore, in the determination processing 500, the computer also determines whether fuel supply parts other than the fuel pump 43 have malfunctions. For example, when the fuel passage is clogged, the fuel leaks from the fuel passage, or the pressure sensor 35 has malfunctions, the computer determines that the fuel supply parts have malfunctions.

In step 501, the computer determines whether the pressure Pf detected by the pressure sensor 35 is less than or equal to a specified threshold pressure Pth. When the answer is YES in step 501, the procedure proceeds to step 502. When the answer is NO, the procedure proceeds to step 503. In step 502, the FPC 47 stores information that the fuel supply parts other than the fuel pump 43 have malfunctions.

In step 503, the computer determines whether the rotation speed Np detected by the speed detection module 47*b* is less than or equal to a specified threshold Nth. When the answer is YES in step 503, the procedure proceeds to step 504. When the answer is NO, the procedure proceeds to step 505. In step 504, the computer determines that the fuel pump 43 has malfunctions. The FPC 47 stores information that the fuel pump 43 has malfunctions. The above processing corresponds to a determination means for determining whether the fuel pump 43 has a malfunction.

In step 505, the computer determines that the fuel supply parts including the fuel pump 43 have no malfunction. The FPC 47 stores information that the fuel supply parts including the fuel pump 43 have no malfunction.

According to the present embodiment, the computer determines whether the fuel supply parts including the fuel pump 43 have malfunctions based on the pressure information detected by the pressure sensor 35. Furthermore, based on the pressure information, the computer can distinguish between the malfunction of the fuel pump 43 and the malfunction of other fuel supply parts.

Sixth Embodiment

Figure 14:
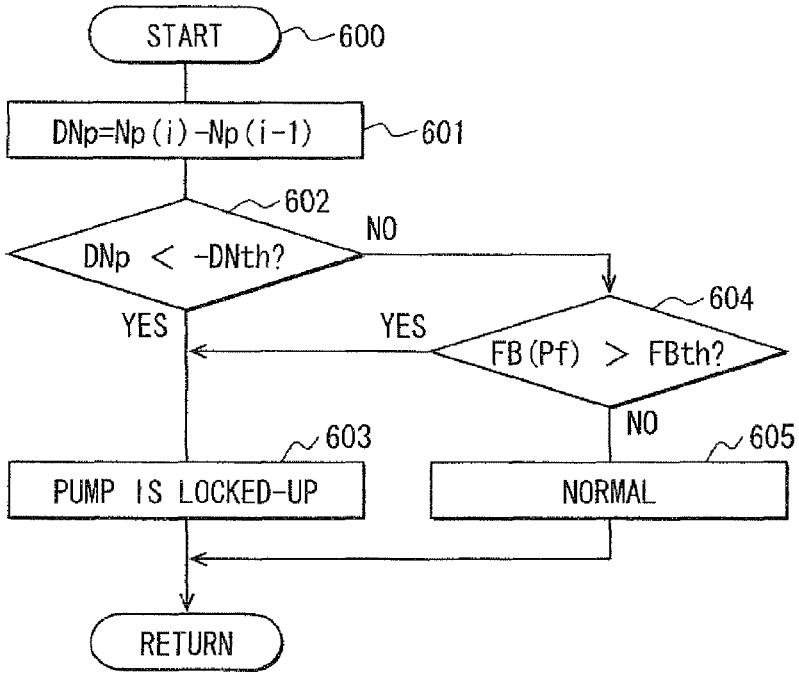
FIG. 14 is a flow chart showing a processing of the fuel supply system according to a sixth embodiment.
Figure 15:
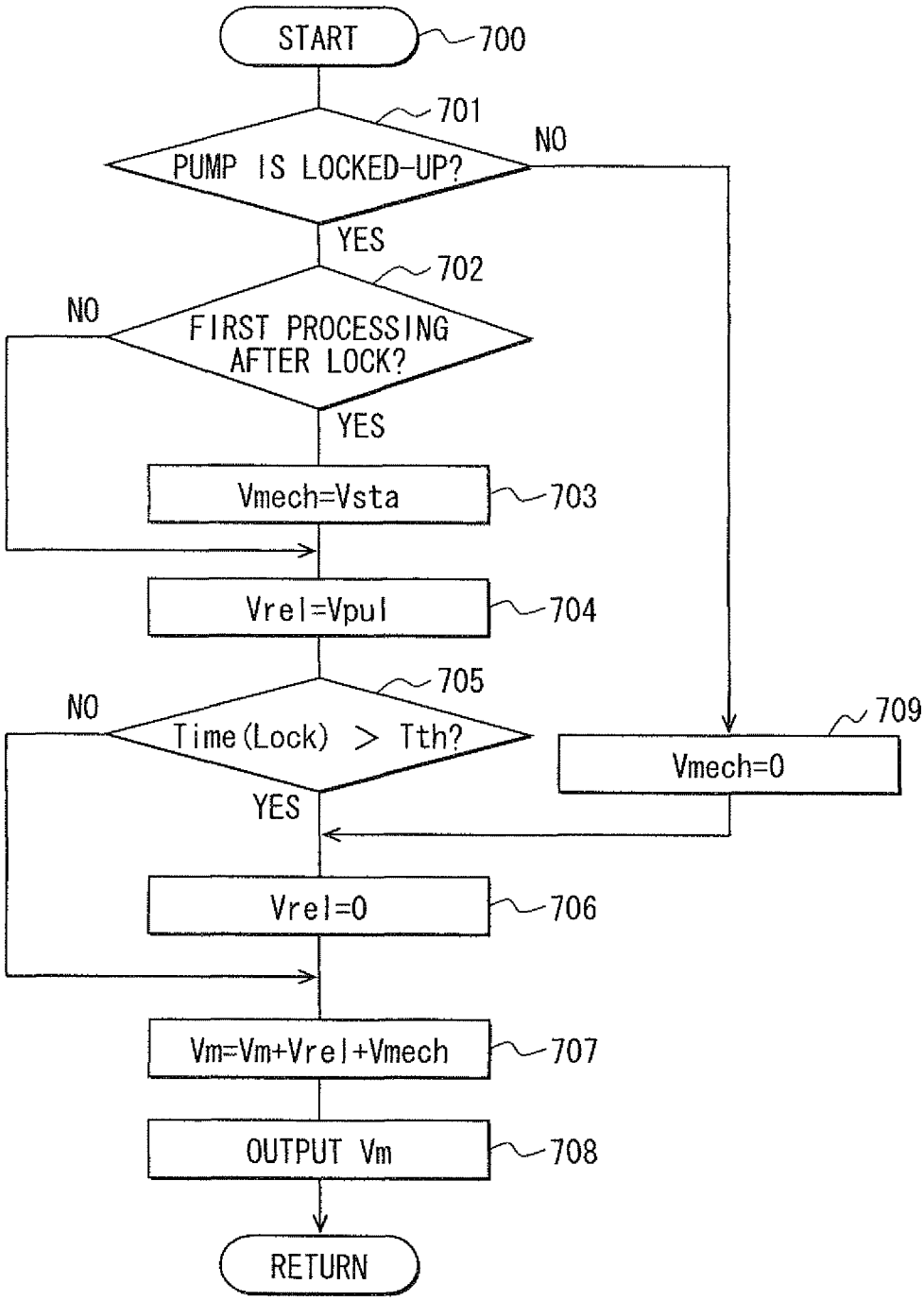
FIG. 15 is a flow chart showing a processing of the fuel supply system according to a sixth embodiment.

FIGS. 14 and 15 are flowcharts showing a malfunction detection processing 600 and a motor control processing 700, respectively. These processings are executed in addition to the control processing described in the first embodiment.

In step 601, the computer computes a differential speed DNp between the current speed Np(i) and the previous speed Np(i−1). The differential speed DNp corresponds to a variation in rotation speed Np. In step 602, the computer determines whether the rotation speed Np is decreased by a specified value. Specifically, the computer determines whether the differential speed DNp is less than a specified threshold "−DNth". If the differential speed DNp is less than "−DNp", it is conceivable that the fuel pump 43 has some malfunctions. For example, the fuel pump 43 suctions foreign matters to be locked up. When the answer is YES in step 602, the procedure proceeds to step 603 in which the computer determines that the fuel pump 43 is locked up. This information is stored in the FPC 47. When the answer is NO in step 602, the procedure proceeds to step 604.

In step 604, the computer determines whether a feedback amount FB(Pf) computed based on the pressure Pf is greater than a specified feedback threshold FBth. When the pressure Pf does not come close to the target pressure, the feedback amount FB(Pf) is set larger. Thus, when the feedback amount FB(Pf) is greater than the feedback threshold FBth, it is conceivable that the fuel pump 43 does not perform sufficiently due to its malfunction such as a lock-up. When the answer is YES in step 604, the procedure proceeds to step 603. When the answer is NO in step 604, the procedure proceeds to step 605. In step 605, the computer determines that the fuel pump 43 is normal and its information is stored in the FPC 47.

The malfunctions of the fuel pump lock-up due to foreign matters can be corrected by increasing electricity supplied to the motor 43*a*. For example, mechanical malfunctions due to foreign matters contained in the fuel can be corrected by increasing a generating torque of the motor 43*a*. Also, electric malfunctions due to insulating material can be corrected by increasing the electricity supplied to the motor 43*a*. In the motor control processing 700, the voltage Vm applied to the motor 43*a* is temporarily increased. The voltage Vm is increased by specified pulse voltage Vpu for releasing the lock-up.

Furthermore, the mechanical load in the fuel pump 43 may increase continuously. For example, if foreign matters remain in the fuel pump 43 over the long time period, the discharge capacity of the fuel pump 43 has been deteriorated for a long time period. Also, when the parts of the fuel pump 43 are deteriorated with age, the discharge capacity of the fuel pump 43 is deteriorated. In the motor control processing 700, the voltage Vm applied to the motor 43*a* is continuously increased in order to keep the initial discharge capacity against an increase in mechanical load. In the present embodiment, the voltage Vm is increased by specified stationary voltage Vsta against the increase in mechanical load.

In step 701, the computer determines whether the fuel pump 43 is locked up. This determination is based on the determination result in step 603. When the answer is YES in step 701, the procedure proceeds to step 702. When the answer is NO in step 701, the procedure proceeds to step 709. In step 702, the computer determines whether it is a first processing after it is determined that the fuel pump 43 is locked up in step 603. When the answer is YES in step 702, the procedure proceeds to step 703. When the answer is NO in step 702, the procedure proceeds to step 704. In step 703, the stationary voltage Vsta is defined as a voltage Vmech for mechanical load. The stationary voltage Vsta is established to maintain the initial discharge capacity against the increase in mechanical load. The process in step 703 corresponds to a driving force assist means for constantly increasing the electric power supplied to the fuel pump 43. In step 704, the pulse voltage Vpul is defined as the voltage Vrel for releasing the lock-up of the fuel pump 43.

In step 705, the computer determines whether an elapsed time Time(Lock) after the lock determination in step 603 exceeds a specified threshold time Tth. When the answer is YES in step 705, the procedure proceeds to step 706. When the answer is NO, the procedure proceeds to step 707. In step 706, the voltage Vrel is set to zero. That is, when the threshold time Tth has elapsed after the lock-up of the fuel pump is detected in step 603, the voltage Vrel is set to zero. Thereby, the voltage Vrel is applied to the motor 43*a* as pulse-form voltage. Therefore, the processings from step 704 to step 706 correspond to a malfunction correction means for temporarily increasing the electric power supplied to the fuel pump 43.

In step 707, the voltage Vm applied to the motor 43*a* is corrected based on the voltage Vrel and the voltage Vmech. Specifically, the voltage Vrel and the voltage Vmech are added to the voltage Vm which is computed based on the feedback amount FB(Pf). In step 708, the voltage Vm is applied to the motor 43*a*. In step 709, the voltage Vmech is set to zero.

Figure 16:
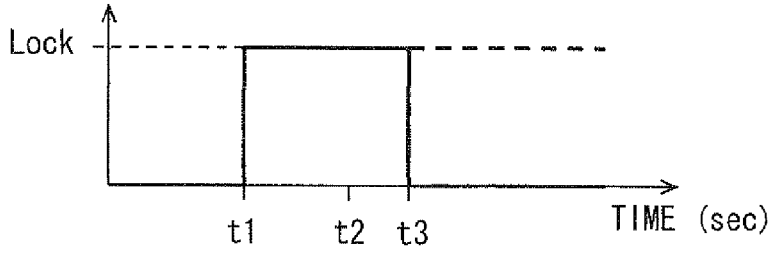
FIG. 16 is a time chart showing lock-up detection according to the sixth embodiment.
Figure 17:
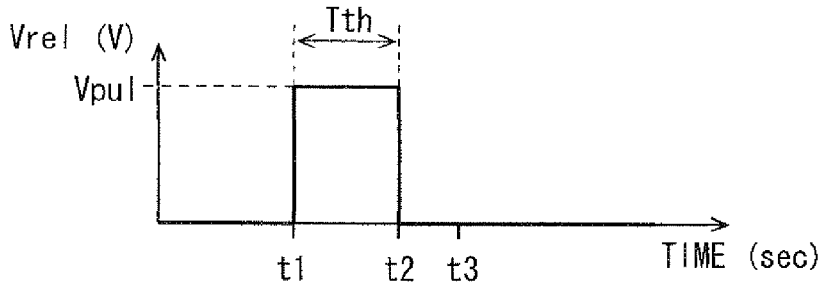
FIG. 17 is a time chart showing a voltage for releasing the lock-up of the fuel pump according to a sixth embodiment.
Figure 18:
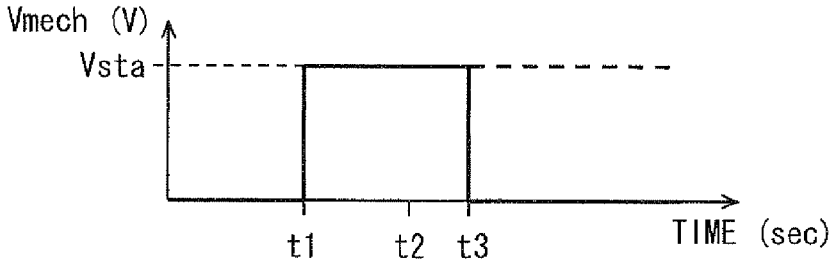
FIG. 18 is a time chart showing a voltage for the mechanical load according to a sixth embodiment.
Figure 19:
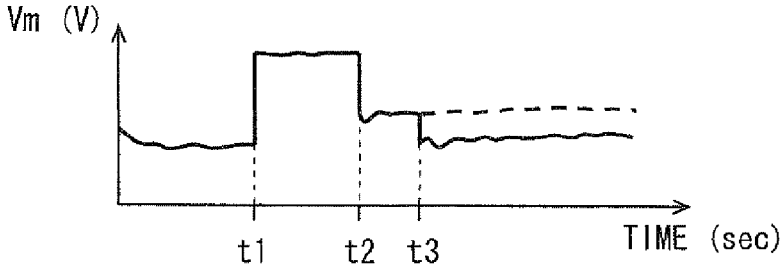
FIG. 19 is a time chart showing a voltage applied to the motor according to a sixth embodiment.

FIG. 16 is a time chart showing lock-up detection. FIG. 17 is a time chart showing the voltage Vrel for releasing the lock-up of the fuel pump 43. FIG. 18 is a time chart showing the voltage Vmech for the mechanical load. FIG. 19 is a time chart showing the voltage Vm applied to the motor 43*a*. When no lock-up of the fuel pump 43 is detected, the voltage Vrel and the voltage Vmech are set to zero in steps 701-709. As a result, the voltage Vm is controlled based on at least the feedback amount FB(Pf).

When the lock-up of the fuel pump 43 is detected at a timing t1, the pulse voltage Vpul and the stationary voltage Vsta are established in steps 701-708. The voltage Vm applied to the motor 43*a* is increased. Thereby, the motor 43*a* can generate the torque necessary for eliminating any malfunctions. Then, when the threshold time Tth has passed, the pulse voltage Vpul is canceled. Also, when the lock-up of the fuel pump 43 is released before the threshold time Tth has passed, the pulse voltage Vpul is canceled. As a result, the voltage Vm is reduced. In FIGS. 16 to 19, the threshold time Tth has passed at the timing t2.

When the lock-up of the fuel pump 43 is released at a timing t3, the stationary voltage Vsta is also canceled. Then, the voltage Vm is controlled based on at least the feedback amount FB(Pf). As shown by broken lines in FIGS. 16, 18, 19, if the fuel pump 43 has been locked up even after the timing t3, the stationary voltage Vsta is also continuously applied. As a result, the voltage Vm is increased by the stationary voltage Vsta.

According to the present embodiment, the computer determines whether the fuel pump 43 is locked up based on the pressure Pf detected by the pressure sensor 35. Since the rotation speed Np of the fuel pump 43 is detected based on the pressure Pf, it is accurately determined whether the fuel pump 43 is locked up. In addition, the correction voltage Vrel can be applied to the motor 43*a* in order to release the lock-up of the fuel pump 43. Further, when the mechanical load of the fuel pump 43 is increased, the correction voltage Vmech can be applied to the motor 43*a* against the increased mechanical load. Thus, even if the mechanical load of the fuel pump 43 is increased, it is restricted that the discharge capacity of the fuel pump 43 is deteriorated.

Other Embodiment

The preferred embodiment is described above. The present invention is not limited to the above embodiment.

The motor 43*a* may be a brushless motor. The hydraulic pump unit 43*b* may be a trochoid gear pump which is one of positive-displacement pumps.

In the above embodiments, the rotation speed Np of the fuel pump 43 is detected based on the pulsation components due to the configuration of the motor 43*a*. The rotation speed Np may be detected based on the pulsation components due to the configuration of the pump unit 43*b*. Alternatively, the rotation speed Np can be detected based on synthesized components of the pulsation components due to the configurations of the motor 43*a* and the pump unit 43*b*.

The peak points or the bottom points of the pulsation components are detected and then the cycle can be obtained from an interval between adjacent peak points or adjacent bottom points.

By executing the discrete Fourier transformation based on a plurality of sampling values of the fuel pressure, the rotation speed Np can be computed.

The fuel pump controller (FPC) 47 can be configured by software, hardware or a combination thereof. For example, the FPC 47 can be configured by an analog circuit.

What is claimed is:

1. A fuel supply system supplying a fuel in a fuel tank to a fuel-consuming apparatus, comprising:

a fuel pump provided with an electric motor;

a sensor for detecting a pulsation component included in a pressure of the fuel which is supplied to the fuel-consuming apparatus from the fuel pump wherein the sensor is a pressure sensor for detecting a pressure of the fuel;

a speed detector for detecting a rotation speed of the fuel pump based on a periodic component of the pulsation component detected by the sensor; and a control unit for controlling the electric motor based on the pressure detected by the pressure sensor and the rotation speed of the fuel pump;

wherein the control unit includes a malfunction correction unit for temporarily increasing an electric power supplied to the fuel pump when the rotation speed of the fuel pump is decreased by a specified value.

2. A fuel supply system according to claim 1, wherein the speed detector detects the rotation speed of the fuel pump based on a cycle of the pulsation component of the pressure detected by the pressure sensor.

3. A fuel supply system according to claim 2, further comprising a determination unit for determining that the fuel pump has a malfunction when the pressure detected by the pressure sensor is greater than a threshold pressure and the rotation speed detected by the speed detector is less than or equal to a threshold speed.

4. A fuel supply system according to claim 3, wherein the determination unit determines that a fuel supply parts other than the fuel pump has a malfunction when the pressure is less than or equal to threshold pressure.

5. A fuel supply system supplying a fuel in a fuel tank to a fuel-consuming apparatus, comprising:

a fuel pump provided with an electric motor;

a sensor for detecting a pulsation component included in a pressure of the fuel which is supplied to the fuel-consuming apparatus from the fuel pump wherein the sensor is a pressure sensor for detecting a pressure of the fuel;

a speed detector for detecting a rotation speed of the fuel pump based on a periodic component of the pulsation component detected by the sensor; and a control unit for controlling the electric motor based on the pressure detected by the pressure sensor and the rotation speed of the fuel pump;

wherein the control unit includes a driving force assist unit for constantly increasing an electric power supplied to the fuel pump when the rotation speed of the fuel pump is decreased by a specified value.

6. A fuel supply system supplying a fuel in a fuel tank to a fuel-consuming apparatus, comprising:

a fuel pump provided with an electric motor;

a sensor for detecting a pulsation component included in a pressure of the fuel which is supplied to the fuel-consuming apparatus from the fuel pump; and a speed detector for detecting a rotation speed of the fuel pump based on a periodic component of the pulsation component detected by the sensor; wherein:

the sensor is a pressure sensor for detecting a pressure of the fuel, and the speed detector detects the rotation speed of the fuel pump based on a cycle of the pulsation component of the pressure detected by the pressure sensor; and the speed detector detects a peak timing point and/or a bottom timing point of pulsation components of the pressure of the fuel by detecting a variation in the pressure of the fuel from an increase to a decrease or from a decrease to an increase, and the speed detector computes the cycle of the pulsation components of the pressure based on the peak timing point and/or the bottom timing point.

7. A fuel supply system supplying a fuel in a fuel tank to a fuel-consuming apparatus, comprising:

a fuel pump provided with an electric motor;

a sensor for detecting a pulsation component included in a pressure of the fuel which is supplied to the fuel-consuming apparatus from the fuel pump; and a speed detector for detecting a rotation speed of the fuel pump based on a periodic component of the pulsation component detected by the sensor;

wherein the sensor is a vibration pickup sensor which detects a vibration of the fuel pump or a vibration of a parts through which the fuel flows from the pump, the speed detector detects the rotation speed of the fuel pump based on a periodic component of a pulsation component contained in the vibration detected by the vibration pickup sensor.

8. A fuel supply system supplying a fuel in a fuel tank to a fuel-consuming apparatus, comprising:

a fuel pump provided with an electric motor;

a sensor for detecting a pulsation component included in a pressure of the fuel which is supplied to the fuel-consuming apparatus from the fuel pump; and a speed detector for detecting a rotation speed of the fuel pump based on a periodic component of the pulsation component detected by the sensor;

wherein the speed detector prohibits a detection of the rotation speed during a specified period immediately after the fuel pump is started.

9. A fuel supply system supplying a fuel in a fuel tank to a fuel-consuming apparatus, comprising:

a fuel pump provided with an electric motor;

a sensor for detecting a pulsation component included in a pressure of the fuel which is supplied to the fuel-consuming apparatus from the fuel pump wherein the sensor is a pressure sensor for detecting a pressure of the fuel;

a speed detector for detecting a rotation speed of the fuel pump based on a periodic component of the pulsation component detected by the sensor; and a control unit for controlling the electric motor based on the pressure detected by the pressure sensor and the rotation speed of the fuel pump; wherein:

the speed detector detects the rotation speed of the fuel pump based on a cycle of the pulsation component of the pressure detected by the pressure sensor; and the speed detector detects a peak timing point and/or a bottom timing point of pulsation components of the pressure of the fuel by detecting a variation in the pressure of the fuel from an increase to a decrease or from a decrease to an increase, and the speed detector computes the cycle of the pulsation components of the pressure based on the peak timing point and/or the bottom timing point.

10. A fuel supply system supplying a fuel in a fuel tank to a fuel-consuming apparatus, comprising:

a fuel pump provided with an electric motor;

a sensor for detecting a pulsation component included in a pressure of the fuel which is supplied to the fuel-consuming apparatus from the fuel pump wherein the sensor is a pressure sensor for detecting a pressure, of the fuel;

a speed detector for detecting a rotation speed of the fuel pump based on a periodic component of the pulsation component detected by the sensor; and a control unit for controlling the electric motor based on the pressure detected by the pressure sensor and the rotation speed of the fuel pump;

wherein the sensor is a vibration pickup sensor which detects a vibration of the fuel pump or a vibration of a parts through which the fuel flows from the pump, the speed detector detects the rotation speed of the fuel pump based on a periodic component of a pulsation component contained in the vibration detected by the vibration pickup sensor.

11. A fuel supply system supplying a fuel in a fuel tank to fuel-consuming apparatus, comprising:

a fuel pump provided with an electric motor;

a sensor for detecting a pulsation component included in a pressure of the fuel which is supplied to the fuel-consuming apparatus from the fuel pump wherein the sensor is a pressure sensor for detecting a pressure of the fuel;

a speed detector for detecting a rotation speed of the fuel pump based on a periodic component of the pulsation component detected by the sensor; and a control unit for controlling the electric motor based on the pressure detected by the pressure sensor and the rotation speed of the fuel pump;

wherein the speed detector prohibits a detection of the rotation speed during a specified period immediately after the fuel pump is started.

* * * * *